US011763718B1

(12) United States Patent
Yang et al.

(10) Patent No.: US 11,763,718 B1
(45) Date of Patent: Sep. 19, 2023

(54) GOA CIRCUIT AND ARRAY SUBSTRATE

(71) Applicant: TCL CHINA STAR OPTOELECTRONICS TECHNOLOGY CO., LTD., Shenzhen (CN)

(72) Inventors: Hui Yang, Shenzhen (CN); Fan Yang, Shenzhen (CN)

(73) Assignee: TCL CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/789,717

(22) PCT Filed: May 27, 2022

(86) PCT No.: PCT/CN2022/095410

§ 371 (c)(1),
(2) Date: Jun. 28, 2022

(30) Foreign Application Priority Data

May 20, 2022 (CN) ..... 202210555237.0

(51) Int. Cl.
*G09G 3/20* (2006.01)

(52) U.S. Cl.
CPC ..... *G09G 3/20* (2013.01); *G09G 2300/0408* (2013.01); *G09G 2300/0819* (2013.01); *G09G 2310/0267* (2013.01); *G09G 2310/08* (2013.01); *G09G 2320/043* (2013.01)

(58) Field of Classification Search
CPC ..... G09G 3/3677; G09G 2310/0286; G09G 2300/0408
See application file for complete search history.

(56) References Cited

U.S. PATENT DOCUMENTS 10,522,105 B2 * 12/2019 Hong ..... G09G 3/20
10,665,192 B2 * 5/2020 Chen ..... G09G 3/3696
10,916,320 B2 * 2/2021 Chen ..... G09G 3/3677
11,315,496 B2 * 4/2022 Xiao ..... G09G 3/3677
11,373,601 B2 * 6/2022 Wang ..... G09G 3/3266
(Continued)

FOREIGN PATENT DOCUMENTS

CN 106486080 A 3/2017
CN 107909971 4/2018
(Continued)

OTHER PUBLICATIONS

PCT International Search Report for International Application No. PCT/CN2022/095410, dated Dec. 20, 2022, 9pp.
(Continued)

*Primary Examiner* — Van N Chow
(74) *Attorney, Agent, or Firm* — The Roy Gross Law Firm, LLC; Roy Gross

(57) ABSTRACT

The present application provides a GOA circuit and an array substrate. The GOA circuit includes a plurality of cascaded gate driving units, wherein an N-th level gate driving unit includes an inversion module, and a portion of a clock signal can be output from an output terminal of the inversion module. Since a frequency of the clock signal is much higher than a frequency of a low-frequency control signal, a duration during which an output signal of the inversion module is kept at a same potential is reduced.

18 Claims, 7 Drawing Sheets

(56) References Cited

U.S. PATENT DOCUMENTS

| | | | | |
|---|---|---|---|---|
| 2004/0196272 | A1* | 10/2004 | Yamashita | G09G 3/3688 345/204 |
| 2013/0331051 | A1* | 12/2013 | Wentzloff | H04B 1/1615 455/230 |
| 2016/0189649 | A1* | 6/2016 | Xiao | G11C 19/28 345/87 |
| 2018/0122318 | A1* | 5/2018 | Cao | G09G 3/3696 |
| 2022/0051595 | A1* | 2/2022 | Chen | G09G 3/006 |

FOREIGN PATENT DOCUMENTS

| | | | |
|---|---|---|---|
| CN | 113362752 | A | 9/2021 |
| WO | 2013002229 | A1 | 1/2013 |

OTHER PUBLICATIONS

PCT Written Opinion of the International Search Authority for International Application No. PCT/CN2022/095410, dated Dec. 20, 2022, 8pp.

* cited by examiner

GOA CIRCUIT AND ARRAY SUBSTRATE

CROSS REFERENCE TO RELATED APPLICATIONS

This application is a National Phase of PCT Patent Application No. PCT/CN2022/095410 having International filing date of May 27, 2022, which claims the benefit of Chinese Patent Application No. 202210555237.0, filed May 20, 2022, the contents of which are all incorporated herein by reference in their entirety.

TECHNICAL FIELD

The present application relates to a display technology field, and more particularly to a GOA circuit and an array substrate.

BACKGROUND

A gate driving circuit may also be referred to as a gate driver on array or gate on array (GOA) circuit, which is a driving technology that adopts an array manufacturing process for an existing thin film transistor display device to prepare a circuit of gate-line-row-scanning-driving-signals on an array substrate so as to realize scanning of the gate lines row by row.

However, in an existing GOA circuit, a low-frequency control signal (LC1 or LC2) is usually used in combination with an inverter to control a corresponding thin film transistor to be in an on state or an off state, which not only increases a number of signal transmission lines (for transmitting LC1 and/or LC2) required by the GOA circuit, but also causes gate potentials of thin film transistors to be in a same potential state for a long time, thereby increasing a stress action to which these thin film transistors are subject and further reducing trustworthiness and reliability of the GOA circuit.

TECHNICAL PROBLEMS

The present application provides a GOA circuit and an array substrate to alleviate technical problems that a larger number of signal transmission lines are required and an output signal of an inversion module is in a same potential state for a long time.

TECHNICAL SOLUTIONS TO THE PROBLEMS

In a first aspect, the present application provides a GOA circuit, and the GOA circuit comprises a plurality of cascaded gate driving units, wherein an N-th level gate driving unit comprises an inversion module, wherein a first control terminal of the inversion module is electrically connected to a pull-up node, and all of a second control terminal of the inversion module, a first input terminal of the inversion module, and a second input terminal of the inversion module are connected with a clock signal; a third input terminal of the inversion module is electrically connected to a low potential line, and an output terminal of the inversion module is configured to output a control signal.

In some implementations, the inversion module comprises a first transistor, a second transistor, a third transistor, and a fourth transistor, wherein one of a source/drain of the first transistor and a gate of the first transistor are both connected with the clock signal; a gate of the second transistor is electrically connected to another one of the source/drain of the first transistor, and one of a source/drain of the second transistor is connected with the clock signal; one of a source/drain of the third transistor is electrically connected to the low potential line, and another one of the source/drain of the third transistor is electrically connected to the gate of the second transistor; and a gate of the fourth transistor is electrically connected to a gate of the third transistor and the pull-up node, one of a source/drain of the fourth transistor is electrically connected to the low potential line, and another one of the source/drain of the fourth transistor is electrically connected to another one of the source/drain of the second transistor to output the control signal.

In some implementations, a channel type of the first transistor is the same as a channel type of the second transistor, a channel type of the third transistor, and a channel type of the fourth transistor.

In some implementations, the N-th level gate driving unit further comprises a first feedback sub-module and a cascaded module, wherein a control terminal of the first feedback sub-module is electrically connected to the output terminal of the inversion module, and one terminal of the first feedback sub-module is electrically connected to the low potential line; and a control terminal of the cascaded module is electrically connected to the pull-up node, one terminal of the cascaded module is connected with the clock signal, and another terminal of the cascaded module is electrically connected to another terminal of the first feedback sub-module.

In some implementations, the first feedback sub-module comprises a fifth transistor, wherein one of a source/drain of the fifth transistor is electrically connected to the low potential line, another of the source/drain of the fifth transistor is electrically connected to another terminal of the cascaded module, and a gate of the fifth transistor is electrically connected to the output terminal of the inversion module; and the cascaded module comprises a sixth transistor, wherein one of a source/drain of the sixth transistor is connected with the clock signal, another of the source/drain of the sixth transistor is electrically connected to another of the source/drain of the fifth transistor, and a gate of the sixth transistor is electrically connected to the pull-up node.

In some implementations, the N-th level gate driving unit further comprises a pull-up module and a second feedback sub-module, wherein a control terminal of the pull-up module is electrically connected to the pull-up node, one terminal of the pull-up module is connected with the clock signal, and another terminal of the pull-up module is electrically connected to an N-th level scanning line; and one terminal of the second feedback sub-module is electrically connected to the low potential line, another terminal of the second feedback sub-module is electrically connected to another terminal of the pull-up module, and a control terminal of the second feedback sub-module is electrically connected to the output terminal of the inversion module.

In some implementations, the second feedback sub-module comprises a seventh transistor, wherein one of a source/drain of the seventh transistor is electrically connected to the low potential line, another of the source/drain of the seventh transistor is electrically connected to another terminal of the pull-up module, and a gate of the seventh transistor is electrically connected to the output terminal of the inversion module.

In some implementations, the N-th level gate driving unit further comprises a third feedback sub-module, wherein one terminal of the third feedback sub-module is electrically connected to the low potential line, another terminal of the third feedback sub-module is electrically connected to the pull-up node, and a control terminal of the third feedback sub-module is electrically connected to the output terminal of the inversion module.

In some implementations, the third feedback sub-module comprises an eighth transistor, wherein one of a source/drain of the eighth transistor is electrically connected to the low potential line, another of the source/drain of the eight transistor is electrically connected to the pull-up node, and a gate of the eighth transistor is electrically connected to the output terminal of the inversion module.

In some implementations, the N-th level gate driving unit further comprises a cascaded module, a pull-up module, a second feedback sub-module, and a fourth feedback sub-module, wherein a control terminal of the cascaded module is electrically connected to the pull-up node, and one terminal of the cascaded module is connected with the clock signal; a control terminal of the pull-up module is electrically connected to the pull-up node, one terminal of the pull-up module is connected with the clock signal, and another terminal of the pull-up module is electrically connected to an N-th level scanning line; one terminal of the second feedback sub-module is electrically connected to the low potential line, and a control terminal of the second feedback sub-module is electrically connected to the output terminal of the inversion module; and one terminal of the fourth feedback sub-module is electrically connected to another terminal of the second feedback sub-module and another terminal of the pull-up module, another terminal of the fourth feedback sub-module is electrically connected to another terminal of the cascaded module, and a control terminal of the fourth feedback sub-module is connected with the clock signal.

In some implementations, the second feedback sub-module comprises a seventh transistor, wherein one of a source/drain of the seventh transistor is electrically connected to the low potential line, and a gate of the seventh transistor is electrically connected to the output terminal of the inversion module; and the fourth feedback sub-module comprises a ninth transistor, wherein one of a source/drain of the ninth transistor is electrically connected to another terminal of the second feedback sub-module and another terminal of the pull-up module, another of the source/drain of the ninth transistor is electrically connected to another terminal of the cascaded module, and a gate of the ninth transistor is connected with the clock signal.

In some implementations, the low potential line is configured to transmit a low potential signal; and an output terminal of the inversion module is configured to output a portion of the clock signal in a pulse duration of the clock signal, and the output terminal of the inversion module is further configured to output a portion of the low potential signal outside the pulse duration.

In some implementations, the pull-up node is configured to provide a corresponding pull-up control signal of which a potential is opposite to a potential of the clock signal during the pulse duration of the clock signal.

In a second aspect, an embodiment of the present application provides an array substrate comprising a clock line and the GOA circuit in the at least one embodiment described above, wherein the clock line is configured to transmit the clock signal.

BENEFICIAL EFFECTS

According to the GOA circuit and the array substrate provided in the embodiments of the present application, the output terminal of the inversion module can output a control signal including a portion of the clock signal by configuring all of the first input terminal, the second input terminal, and the second control terminal of the inversion module each to be connected with the clock signal. Since the frequency of the clock signal is far higher than the frequency of the low-frequency control signal, the potential of the output signal of the inversion module can be alternately switched at a relatively fast speed between the high potential and the low potential. Therefore, the duration during which the output signal of the inversion module is kept at the same potential is reduced, and the stress action to which the thin film transistor connected to the output terminal of the inversion module is subjected can be reduced, thereby improving trustworthiness and reliability of the GOA circuit. Meanwhile, the inversion module shares the clock line commonly used by the GOA circuit, which saves the signal transmission line for transmitting the low-frequency control signal and further reduces a bezel space required by the GOA circuit.

EMBODIMENTS OF THE PRESENT APPLICATION

To make the objectives, technical solutions, and effects of the present application more clear and definite, the present application is illustrated in detail below by referring to the accompanying drawings and illustrating the embodiments. It should be understood that the specific implementations described here are only used to explain the present application, and are not used to limit the present application.

Figure 1:
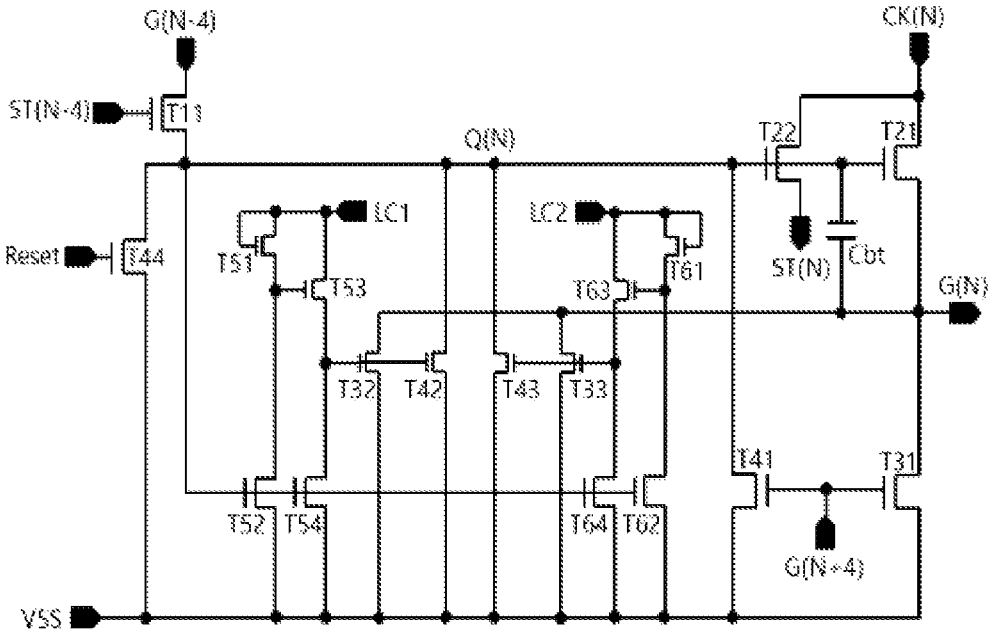
FIG. 1 (Prior Art)
FIG. 1 is a schematic structural diagram of a GOA circuit in the related art.

FIG. 1 is a schematic structural diagram of a GOA circuit in the related art. The GOA circuit includes a plurality of cascaded gate driving units. In an N-th level gate driving unit, one of a source/drain of a thin film transistor T11 is electrically connected to an (N−4)th level scanning line, a gate of the thin film transistor T11 is electrically connected to an (N−4)th level cascaded line, and one of a source/drain of a thin film transistor T44 is electrically connected to another one of the source/drain of the thin film transistor T11; a gate of a thin film transistor T52, a gate of a thin film transistor T54, a gate of a thin film transistor T64, a gate of a thin film transistor T62, a gate of a thin film transistor T22, a gate of a thin film transistor T21, one terminal of a capacitor Cbt, one of a source/drain of a thin film transistor T42, one of a source/drain of a thin film transistor T43, and one of a source/drain of a thin film transistor T41, and another one of the source/drain of the thin film transistor T44 is electrically connected to a low potential line; one of a source/drain of the thin film transistor T52, one of a source/ drain of the thin film transistor T54, one of a source/drain of a thin film transistor T32, another one of the source/drain of the thin film transistor T42, another one of the source/drain of the thin film transistor T43, one of a source/drain of a thin film transistor T33, one of a source/drain of the thin film transistor T64, one of a source/drain of the thin film transistor T62, another one of the source/drain of the thin film transistor T41, and one of a source/drain of a thin film transistor T31; an N-th clock line is electrically connected to one of a source/drain of the thin film transistor T22, and one of a source/drain of the thin film transistor T21, and another one of the source/drain of the thin film transistor T22 is electrically connected to an N-th level cascaded line; another one of the source/drain of the thin film transistor T21 is electrically connected to another one of the source/drain of the thin film transistor T31 and an N-th level scanning line; a gate of the thin film transistor T44 is electrically connected to a reset line; a first low frequency control line is electrically connected to one of a source/drain of a thin film transistor T51, a gate of the thin film transistor T51, and one of a source/drain of a thin film transistor T53; another one of the source/drain of the thin film transistor T51 is electrically connected to a gate of the thin film transistor T53 and another one of the source/drain of the thin film transistor T52; another one of the source/drain of the thin film transistor T53 is electrically connected to another one of the source/drain of the thin film transistor T54, a gate of the thin film transistor T32, and a gate of the thin film transistor T42; another one of the source/drain of the thin film transistor T32 is electrically connected to another one of the source/drain of the thin film transistor T33, another terminal of the capacitor Cbt, and the another one of the source/drain of the thin film transistor T21; a second low frequency control line is electrically connected to one of a source/drain of a thin film transistor T61, a gate of the thin film transistor T61, and one of a source/drain of a thin film transistor T63; another one of the source/drain of the thin film transistor T61 is electrically connected to another one of the source/drain of the thin film transistor T62 and a gate of the thin film transistor T63; another one of the source/drain of the thin film transistor T63 is electrically connected to another one of the source/drain of the thin film transistor T64, a gate of the thin film transistor T33, and a gate of the thin film transistor T43; and an (N+4)th level scanning line is electrically connected to a gate of the thin film transistor T31 and a gate of the thin film transistor T41.

A first inversion module is constructed with the thin film transistor T51, the thin film transistor T52, the thin film transistor T53, and the thin film transistor T54. A second inversion module is constructed with the thin film transistor T61, the thin film transistor T62, the thin film transistor T63, and the thin film transistor T64.

The (N−4)th level scanning line is configured to transmit an (N−4)th level scanning signal G(N−4). The (N+4)th level scanning line is configured to transmit an (N+4)th level scanning signal G(N+4). The N-th level scanning line is configured to transmit an N-th level scanning signal G(N). The reset line is configured to transmit a reset signal Reset. The low potential line is configured to transmit a low potential signal VSS. The first low-frequency control line is configured to transmit a first low-frequency control signal LC1. The second low-frequency control line is configured to transmit a second low-frequency control signal LC2. The (N−4)th level cascaded line is configured to transmit an (N−4)th level cascaded signal ST(N−4). The N-th level cascaded line is configured to transmit an N-th level cascaded signal ST(N). The N-th clock line is configured to transmit an N-th clock signal CK(N).

It should be noted that the GOA circuit shown in FIG. 1 does not pull down the N-th level cascaded signal ST(N) output from another one of the source/drain of the thin film transistor T22, while the another one of the source/drain of the thin film transistor T22 remains floating, which reduces trustworthiness of the cascaded signal.

Figure 2:
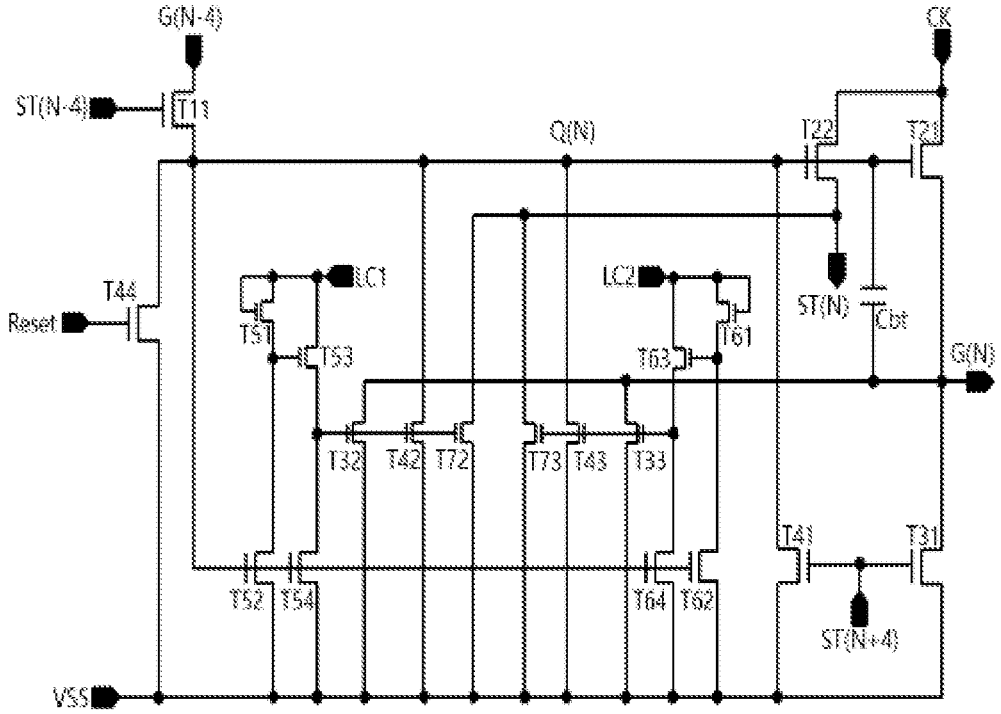
FIG. 2 (Prior Art)
FIG. 2 is another schematic structural diagram of the GOA circuit in the related art.

In comparison with FIG. 1, a thin film transistor T72 and a thin film transistor T73 are added to the GOA circuit shown in FIG. 2, and the first inversion module, through the thin film transistor T72, and the second inversion module, through the thin film transistor T73, alternately pull down a potential of another one of the source/drain of the thin film transistor T22. One of a source/drain of the thin film transistor T72 is electrically connected to the low potential line, another one of the source/drain of the thin film transistor T72 is electrically connected to the another one of the source/drain of the thin film transistor T22, and a gate of the thin film transistor T72 is electrically connected to the gate of the thin film transistor T42. One of a source/drain of the thin film transistor T73 is electrically connected to the low potential line, another one of the source/drain of the thin film transistor T73 is electrically connected to the another one of the source/drain of the thin film transistor T22, and a gate of the thin film transistor T73 is electrically connected to the gate of the thin film transistor T43.

In addition, the one of the source/drain of the thin film transistor T11 is instead electrically connected to the (N−4) th level scanning line for transmitting the (N−4)th level scanning signal G(N−4), and the gate of the thin film transistor T11 is instead electrically connected to the (N−4) th level cascaded line for transmitting the (N−4)th level cascaded signal ST(N−4). The gate of the thin film transistor T44 is instead electrically connected to an initial line for transmitting the reset signal Reset. The gate of the thin film transistor T31 and the gate of the thin film transistor T41 are instead electrically connected to the (N+4)th level scanning line for transmitting the (N+4)th level scanning signal G(N+4).

It should be noted that, although the GOA circuit shown in FIG. 2 pulls down the N-th level cascaded signal ST(N) output from the another one of the source/drain of the thin film transistor T22, the first inversion module, through the thin film transistor T72, and the second inversion module through, the thin film transistor T73, need to perform an alternately pull-down operation, which not only increases a number of the inversion modules, but also increases a number of the thin film transistors used. Therefore, it is disadvantageous for realization of a narrow bezel.

Figure 3:
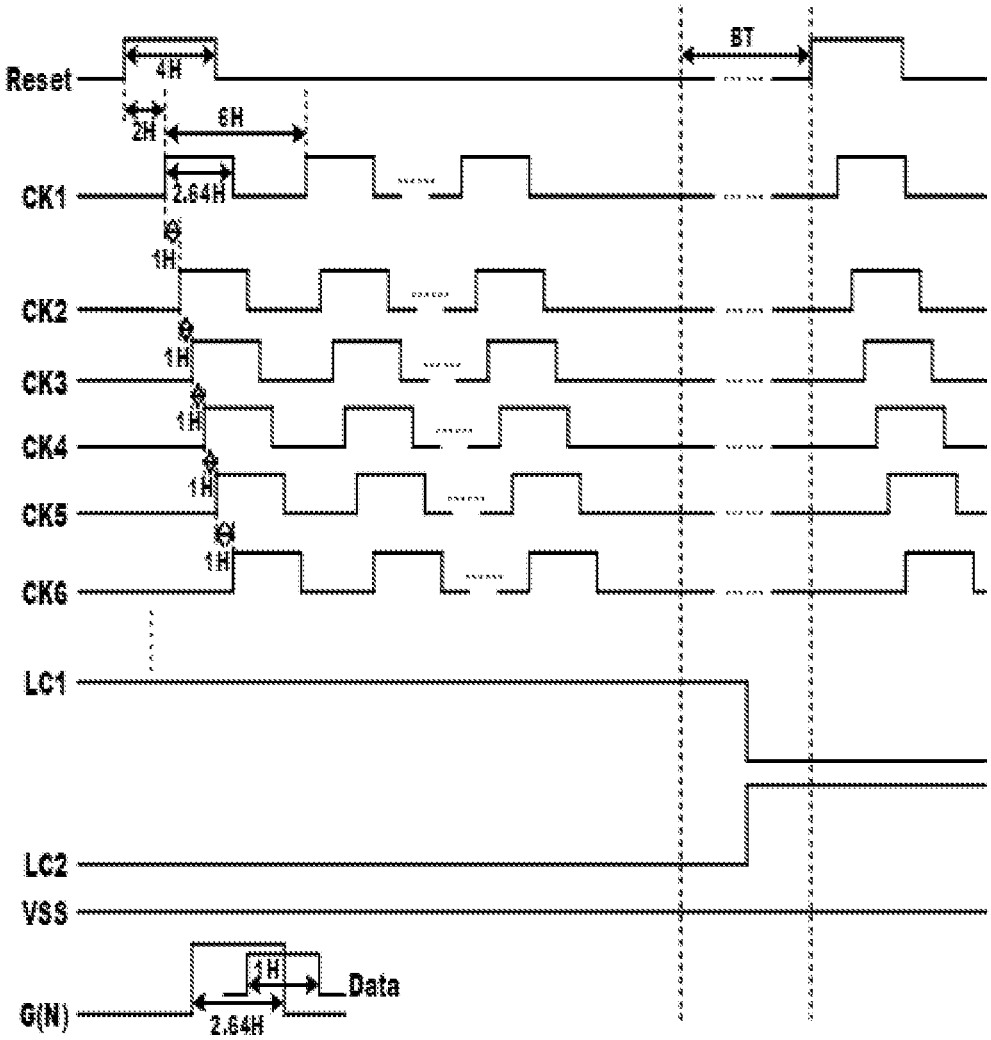
FIG. 3 is a schematic timing diagram of the GOA circuit shown in FIG. 1 and FIG. 2.

As shown in FIG. 3, phases of a first clock signal CK1 to a sixth clock signal CK6 having a same frequency are lagged successively. A plurality of pulse durations of a clock signal (for example, any of the first clock signal CK1 to the sixth clock signal CK6) may be included in one pulse duration of the first low-frequency control signal LC1 or the second low-frequency control signal LC2. Therefore, it can be known that, in the GOA circuit, a frequency of the low-frequency control signal (e.g., the first low-frequency control signal LC1 or the second low-frequency control signal LC2) is much lower than a frequency of the clock signal. The first low frequency control line and the second low frequency control line may both be one of signal transmission lines.

Figure 4:
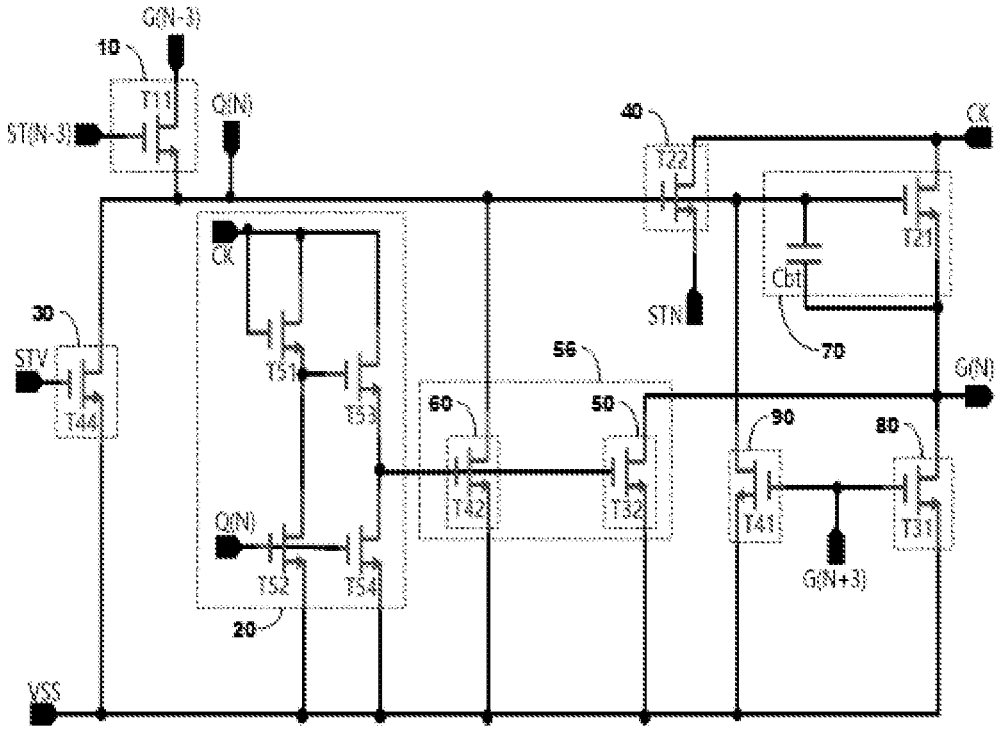
FIG. 4 is a first structural diagram of a GOA circuit according to an embodiment of the present application.

In view of the above-mentioned technical problems that a larger number of the signal transmission lines are required and an output signal of the first inversion module and/or the second inversion module is in a same potential state for a long time, the present embodiment provides a GOA circuit. Referring to FIGS. 4 to 7, as shown in FIG. 4, the GOA circuit includes a plurality of cascaded gate driving units, where an N-th level gate driving unit includes an inversion module 20, a first control terminal of the inversion module 20 is electrically connected to a pull-up node Q(N), all of a second control terminal of the inversion module 20, a first input terminal of the inversion module 20, and a second input terminal of the inversion module 20 are connected with a clock signal CK, a third input terminal of the inversion module 20 is electrically connected to the low potential line, and an output terminal of the inversion module 20 is configured to output a control signal. That is, a portion of the clock signal CK and a portion of the low potential signal VSS alternatively constructs the control signal.

It can be understood that, according to the GOA circuit provided in the embodiment, the output terminal of the inversion module 20 can output a control signal by configuring all of the first input terminal of the inversion module 20, the second input terminal of the inversion module 20, and the second control terminal of the inversion module 20 to be connected with the clock signal CK. Since the frequency of the clock signal CK is far higher than the frequency of the low-frequency control signal, a potential of the output signal of the inversion module 20 can be alternately switched at a relatively fast speed between a high potential and a low potential. Therefore, a duration during which the output signal of the inversion module 20 is kept at a same potential is reduced, and a stress action to which the thin film transistors connected to the output terminal of the inversion module 20 is subject can be reduced, thereby improving trustworthiness and reliability of the GOA circuit. Meanwhile, the inversion module 20 shares the clock line commonly used by the GOA circuit, which saves the number of the signal transmission lines for transmitting the low-frequency control signal and further reduces wiring space required by the GOA circuit. Therefore, it is advantageous for realization of the narrow bezel.

In one of the embodiments, the inversion module 20 includes the first transistor T51, the second transistor T53, the third transistor T52, and the fourth transistor T54, where the one of a source/drain of the first transistor T51 and a gate of the first transistor T51 are connected with the clock signal CK; a gate of the second transistor T53 is electrically connected to another one of the source/drain of the first transistor T51, and one of a source/drain of the second transistor T53 is connected with the clock signal CK; one of a source/drain of the third transistor T52 is electrically connected to the low potential line, and another one of the source/drain of the third transistor T52 is electrically connected to the gate of the second transistor T53; and a gate of the fourth transistor T54 is electrically connected to the gate of the third transistor T52 and the pull-up node Q(N); one of a source/drain of the fourth transistor T54 is electrically connected to the low potential line, and another one of the source/drain of the fourth transistor T54 is electrically connected to the another one of the source/drain of the second transistor T53 to output a control signal.

It should be noted that the low potential line is configured to transmit a low potential signal VSS or constant-voltage low potential signal. The control signal described above may include a pulse portion between a rising edge and a falling edge of the clock signal CK.

In one of the embodiments, a channel type of the first transistor T51 is the same as all of a channel type of the second transistor T53, a channel type of the third transistor T52, and a channel type of the fourth transistor T54. For example, all may be an N-channel, and in this state, the inversion module 20 outputs a forward pulse type signal; and all may also be a P-channel, and in this state, the inversion module 20 may output a negative pulse type signal.

In one of the embodiments, the N-th level gate driving unit further includes a pull-up control module 10, a pull-up module 70, and a feedback module 56. One terminal of the pull-up control module 10 is electrically connected to a first scanning line, a control terminal of the pull-up control module 10 is electrically connected to a first cascaded line, and another terminal of the pull-up control module 10 is electrically connected to the pull-up node Q(N). A control terminal of the pull-up module 70 is electrically connected to another terminal of the pull-up control module 10, one terminal of the pull-up module 70 is connected with the clock signal CK, and another terminal of the pull-up module 70 is electrically connected to the N-th level scanning line. One terminal of the feedback module 56 is electrically connected to the low potential line, another terminal of the feedback module 56 is electrically connected to a corresponding node, and a control terminal of the feedback module 56 is electrically connected to the output terminal of the inversion module 20.

It should be noted that each of the gate driving units generally needs to be electrically connected to at least one clock line to obtain a required clock signal, where one terminal of the pull-up module 70 is also generally electrically connected to the clock line to output a corresponding clock signal as a scanning signal to use. It can be understood that, in the embodiment, the inversion module 20 may share the clock line commonly used by the GOA circuit, thereby saving the signal transmission line for transmitting the low-frequency control signal, and further reducing the wiring space required by the GOA circuit.

In one of the embodiments, the pull-up control module 10 includes a thin film transistor T11, where one of a source/drain of the thin film transistor T11 is electrically connected to the first scanning line, a gate of the thin film transistor T11 is electrically connected to the first cascaded line, and another one of the source/drain of the thin film transistor T11 is electrically connected to the pull-up node Q(N).

Wherein the first scanning line may be configured to transmit a scanning signal other than the N-th level scanning signal G(N), for example, one of an (N−1)th level scanning signal, an (N−2)th level scanning signal, an (N−3)th level scanning signal G(N−3), an (N−−4)th level scanning signal, or the like. The first cascaded line may be configured to transmit a cascaded signal other than the N-th level cascaded signal STN, for example, one of an (N−1)th level cascaded signal, an (N−2)th level cascaded signal, an (N−3)th level cascaded signal ST(N−3), an (N−4)th level cascaded signal, or the like.

In an embodiment, the pull-up module 70 may include a thin film transistor T21, where one of a source/drain of the thin film transistor T21 is connected with the clock signal CK, a gate of the thin film transistor T21 is electrically connected to the pull-up node Q(N), and another one of the source/drain of the thin film transistor T21 is electrically connected to the N-th level scanning signal.

Wherein the N-th level scanning line is configured to transmit an N-th level scanning signal G(N).

In one of the embodiments, the pull-up module 70 may further include a capacitor Cbt, where one terminal of the capacitor Cbt is electrically connected to the gate of the thin film transistor T21, and another terminal of the capacitor Cbt is electrically connected to another one of the source/drain of the thin film transistor T21.

In one of the embodiments, the N-th level gate driving unit further includes a cascaded module 40, where one terminal of the cascaded module 40 is connected with the clock signal CK, a control terminal of the cascaded module 40 is electrically connected to the another terminal of the pull-up control module 10, and another terminal of the cascaded module 40 is electrically connected to the N-th level cascaded line.

The N-th level cascaded line is configured to transmit an N-th level cascaded signal STN.

In one of the embodiments, the cascaded module 40 may include a sixth transistor T22, where one of a source/drain of the sixth transistor T22 is connected with the clock signal CK, a gate of the sixth transistor T22 is electrically connected to the another one of the source/drain of the thin film transistor T11, and another one of the source/drain of the sixth transistor T22 is electrically connected to the N-th level cascaded line.

Figure 5:
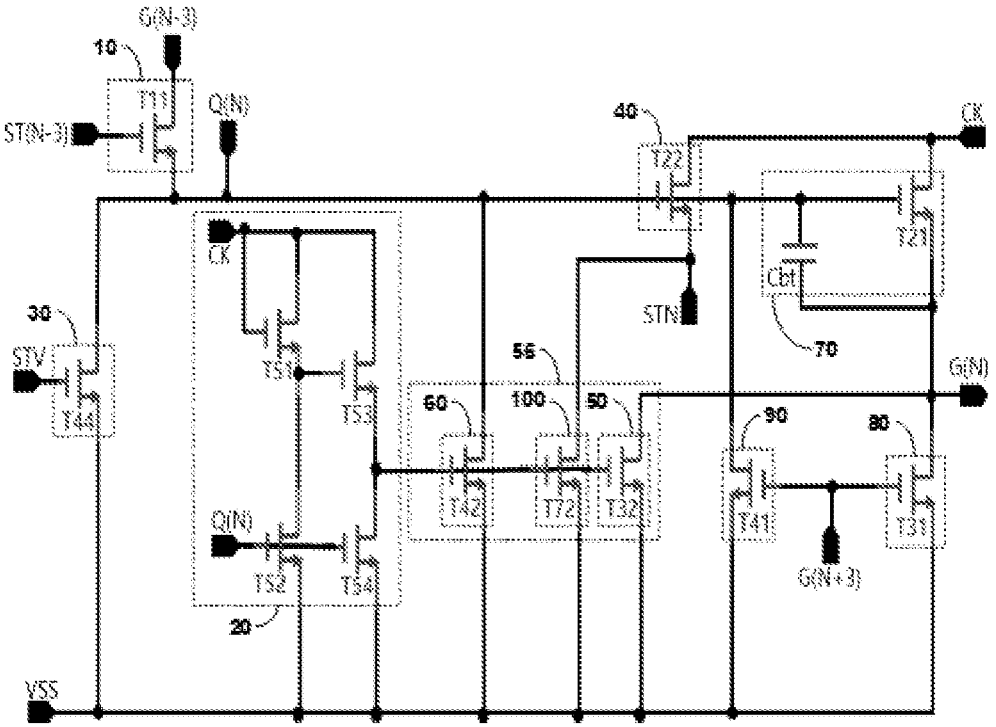
FIG. 5 is a second structural diagram of the GOA circuit according to an embodiment of the present application.

In one of the embodiments, as shown in FIG. 5, the feedback module 56 includes a first feedback sub-module 100, where, a control terminal of the first feedback sub-module 100 is electrically connected to the output terminal of the inversion module, one terminal of the first feedback sub-module 100 is electrically connected to the low potential line, and another terminal of the first feedback sub-module 100 is electrically connected to the another terminal of the cascaded module 40.

It should be noted that, since the frequency of the clock signal CK is much higher than the frequency of the low-frequency control signal, the potential of the output signal of the inversion module 20 can be alternately switched between the high potential and the low potential at a relatively high speed. Therefore, a duration during which the control terminal of the first feedback sub-module 100 is kept at a same potential is reduced, and a stress action to which the control terminal of the first feedback sub-module 100 is subject can be reduced, thereby improving the trustworthiness and the reliability of the GOA circuit.

Furthermore, the first feedback sub-module 100 can pull down the cascaded signal output from the cascaded module 40 under a control of the inversion module 20 by electrically connecting the one terminal of the first feedback sub-module 100 to the low potential line and the another terminal of the cascaded module 40 to the another terminal of the first feedback sub-module 100, thereby preventing a floating state of the cascaded signal, improving trustworthiness of the cascaded signal, and further improving the trustworthiness of the GOA circuit.

Furthermore, the inversion module 20 and the cascaded module 40 may share the clock line commonly used by the GOA circuit, thereby saving the signal transmission line for transmitting the low-frequency control signal, and further reducing the wiring space required by the GOA circuit.

In one of the embodiments, the first feedback sub-module 100 includes a fifth transistor T72, where one of a source/drain of the fifth transistor T72 is electrically connected to the low potential line, another one of the source/drain of the fifth transistor T72 is electrically connected to the another terminal of the cascaded module 40, and a gate of the fifth transistor T72 is electrically connected to the output terminal of the inversion module.

It should be noted that, in the embodiment, the inversion module 20 can control the fifth transistor T72 to switch between an on state and an off state at a faster frequency to reduce a duration during which a potential of the gate of the fifth transistor T72 is kept at a same potential state for a long time. Therefore, an electrical stress action to which the fifth transistor T72 is subject can be reduced, a service life of the fifth transistor T72 can be improve, and a threshold voltage drift range of the fifth transistor T72 can be reduced, thereby further improving the trustworthiness and the reliability of the GOA circuit.

In one of the embodiments, as shown in FIGS. 4 and 5, the feedback module 56 includes a second feedback sub-module 50, where one terminal of the second feedback sub-module 50 is electrically connected to the low potential line, another terminal of the second feedback sub-module 50 is electrically connected to the another terminal of the pull-up module 70, and a control terminal of the second feedback sub-module 50 is electrically connected to the output terminal of the inversion module 20.

It should be noted that, in the embodiment, the inversion module 20 can control the second feedback sub-module 50 to switch between the on and off states at a faster frequency to reduce a duration during which the control terminal of the second feedback sub-module 50 is kept at a same potential is reduced. Therefore, a stress action to which the control terminal of the second feedback sub-module 50 is subject can be reduced, thereby improving the trustworthiness and the reliability of the GOA circuit.

In one of the embodiments, the second feedback sub-module 50 includes a seventh transistor T32, where one of a source/drain of the seventh transistor T32 is electrically connected to the low potential line, another of the source/drain of the seventh transistor T32 is electrically connected to the another terminal of the pull-up module 70, and a gate of the seventh transistor T32 is electrically connected to the output terminal of the inversion module 20.

It should be noted that, in the embodiment, the inversion module 20 can control the seventh transistor T32 to switch between the on state and the off state at a faster frequency to reduce a duration during which a potential of the gate of the seventh transistor T32 is kept at a same potential state for a long time. Therefore, an electrical stress action to which the seventh transistor T32 is subject can be reduced, a service life of the seventh transistor T32 can be improve, and a threshold voltage drift range of the seventh transistor T32 can be reduced, thereby further improving the trustworthiness and the reliability of the GOA circuit.

In one of the embodiments, the feedback module 56 further includes a third feedback sub-module 60, one terminal of the third feedback sub-module 60 is electrically connected to the low potential line, another terminal of the third feedback sub-module 60 is electrically connected to the another terminal of the pull-up control module 10, and a control terminal of the third feedback sub-module 60 is electrically connected to the output terminal of the inversion module 20.

It should be noted that, in the embodiment, the inversion module 20 can control the third feedback sub-module 60 to switch between the on and off states at a faster frequency to reduce a duration during which the control terminal of the third feedback sub-module 60 is kept at a same potential state for a long time. Therefore, a stress action to which the control terminal of the third feedback sub-module 60 is subject can be reduced, thereby improving the trustworthiness and the reliability of the GOA circuit.

In one of the embodiments, the third feedback sub-module 60 includes an eighth transistor T42, where one of a source/drain of the eighth transistor T42 is electrically connected to the low potential line, another one of the source/drain of the eighth transistor T42 is electrically connected to the another terminal of the pull-up control module 10, and a gate of the eighth transistor T42 is electrically connected to the output terminal of the inversion module 20.

It should be noted that, in the embodiment, the inversion module 20 can control the eighth transistor T42 to switch between the on state and the off state at a faster frequency to reduce a duration during which a potential of the gate of the eighth transistor T42 is kept at a same potential state for a long time. Therefore, an electrical stress action to which the eighth transistor T42 is subject can be reduced, a service life of the eighth transistor T42 can be improve, and a threshold voltage drift range of the eighth transistor T42 can be reduced, thereby further improving the trustworthiness and the reliability of the GOA circuit.

Figure 6:
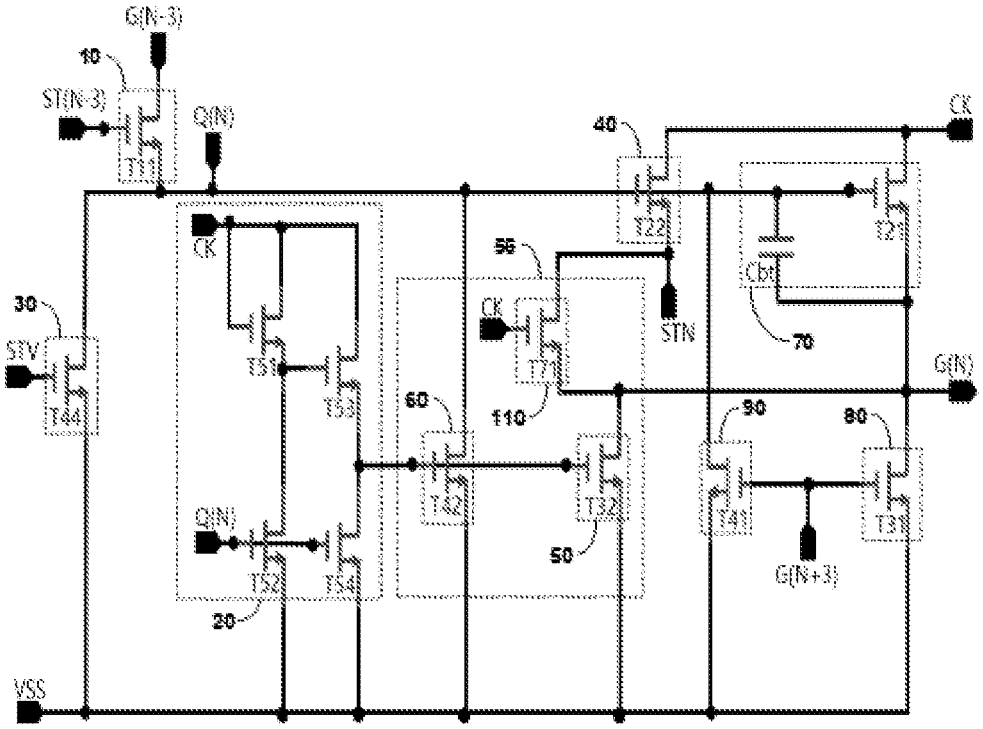
FIG. 6 is a third structural diagram of the GOA circuit according to an embodiment of the present application.

In one of the embodiments, as shown in FIG. 6, the feedback module 56 further includes a fourth feedback sub-module 110, where one terminal of the fourth feedback sub-module 110 is electrically connected to another terminal of the second feedback sub-module 50, another terminal of the fourth feedback sub-module 110 is electrically connected to the another terminal of the cascaded module 40, and a control terminal of the fourth feedback sub-module 110 is connected with the clock signal CK.

It should be noted that, in the embodiment, the inversion module 20 can control the second feedback sub-module 50 to switch between the on and off states at a faster frequency. On a basis of this, the fourth feedback sub-module 110 may be also switched between the on and off states at a faster frequency under a control of the clock signal CK, so that not only a potential of the control terminal of the second feedback sub-module 50 is kept at a same potential state for a long time can be reduced, but also a potential of the control terminal of the fourth feedback sub-module 110 is kept at a same potential state for a long time can be reduced, thereby reducing the stress action to which the control terminal of the second feedback sub-module 50 and the control terminal of the fourth feedback sub-module 110 are subject, and improving the trustworthiness and the reliability of the GOA circuit.

Furthermore, compared with a case where a potential at another terminal of the cascaded module 40 is directly pulled down by the thin film transistor T72 and the thin film transistor T73 in FIG. 2, more signal transmission wirings are required, which requires a greater film layer thickness in the display panel. The GOA circuit shown in FIG. 6 can realize the pull-down operation of the cascaded module 40 by means of the second feedback sub-module 50 and the fourth feedback sub-module 110, thereby reducing a number of signal transmission wirings required and the film layer thickness required. Therefore, more longitudinal (e.g., a thickness direction) spaces may be provided for the thin film transistor T11, the thin film transistor T31, the thin film transistor T41, the thin film transistor T32, and the thin film transistor T42, thereby saving spaces for the display panel.

Furthermore, the control terminal of the fourth feedback sub-module 110 is controlled by driving of the clock signal, so that the potential of the control terminal of the fourth feedback sub-module 110 is kept at a same potential state for a long time and the stress action to which the control terminal of the fourth feedback sub-module 110 is subject can be reduced. Therefore, it is advantageous for extending a service life of the fourth feedback sub-module 110, thereby further improving the trustworthiness and the reliability of the GOA circuit.

In one of the embodiments, the fourth feedback sub-module 110 includes a ninth transistor T71, where one of a source/drain of the ninth transistor T71 is electrically connected to the another terminal of the second feedback sub-module 50, another one of the source/drain of the ninth transistor T71 is electrically connected to the another terminal of the cascaded module 40, and a gate of the ninth transistor T71 is connected with the clock signal CK.

It should be noted that, in the embodiment, the inversion module 20 can control the second feedback sub-module 50 to switch between the on and off states at a faster frequency. On the basis of this, the ninth transistor T71 may also be switched between the on and off states at a faster frequency under the control of the clock signal CK, so that not only the potential of the control terminal of the second feedback sub-module 50 is kept at the same potential state for a long time can be reduced, but also a potential of the gate of the ninth transistor T71 is kept at a same potential state for a long time can be reduced, thereby reducing the stress action to which the control terminal of the second feedback sub-module 50 and the gate of the ninth transistor T71 are subject, and improving the trustworthiness and the reliability of the GOA circuit.

Furthermore, compared with the case where the potential at the another terminal of the cascaded module 40 is directly pulled down by the thin film transistor T72 and the thin film transistor T73 in FIG. 2, more signal transmission wirings are required, which requires a greater film layer thickness in the display panel. The GOA circuit shown in FIG. 6 can realize the pull-down operation of the cascaded module 40 by means of the second feedback sub-module 50 and the ninth transistor T71, thereby reducing the number of signal transmission wirings required and the film layer thickness required. Therefore, more longitudinal (e.g., a thickness direction) spaces may be provided for the thin film transistor T11, the thin film transistor T31, the thin film transistor T41, the thin film transistor T32, and the thin film transistor T42, thereby saving the spaces for the display panel.

Furthermore, the gate of the ninth transistor T71 is controlled by driving of the clock signal, so that the potential of the gate of the ninth transistor T71 is kept at the same potential state for a long time and the stress action to which the gate of the ninth transistor T71 is subject can be reduced. Therefore, it is advantageous for extending a service life of the ninth transistor T71, thereby further improving the trustworthiness and the reliability of the GOA circuit.

In one of the embodiments, the low potential line is configured to transmit the low potential signal VSS; and the output terminal of the inversion module 20 is configured to output a portion of the clock signal CK in a pulse duration of the clock signal CK, and the output terminal of the inversion module 20 is further configured to output a portion of the low potential signal VSS outside the pulse duration.

It should be noted that the output terminal of the inversion module 20 may output a pulse signal; the pulse signal is a voltage supplied by the clock signal CK in the pulse duration thereof, and the pulse signal is a voltage supplied by the low potential signal VSS outside the pulse duration thereof. That is, the pulse signal is combined by the clock signal CK and the low potential signal VSS.

In one of the embodiments, the pull-up node Q(N) is configured to provide a corresponding pull-up control signal, and a potential of the pull-up control signal is opposite to a potential of the clock signal during the pulse duration of the clock signal CK.

It can be understood that, when the potential of the pull-up control signal is at the high potential, the potential of the clock signal CK is at the low potential, so that the inversion module 20 outputs the low potential signal VSS; and when the potential of the pull-up control signal is at the low potential, the potential of the clock signal CK is at the high potential, so that the inversion module 20 outputs the clock signal CK.

In one of the embodiments, the N-th level gate driving unit further includes a reset module 30, where one terminal of the reset module 30 is electrically connected to another terminal of the pull-up control module 10, a control terminal of the reset module 30 is electrically connected to an initial line, and another terminal of the reset module 30 is electrically connected to the low-potential line.

The initial line may be configured to transmit an initial signal STV or the reset signal Reset shown in FIGS. 1 and 2.

In one of the embodiments, the reset module 30 includes a thin film transistor T44, where one of a source/drain of the thin film transistor T44 is electrically connected to the another one of the source/drain of the thin film transistor T11, a gate of the thin film transistor T44 is electrically connected to the initial line, and another one of the source/drain of the thin film transistor T44 is electrically connected to the low potential line.

In one of the embodiments, the N-th level gate driving unit further includes a first pull-down module 80, where one terminal of the first pull-down module 80 is electrically connected to the another terminal of the pull-up module 70, a control terminal of the first pull-down module 80 is electrically connected to a second scanning line, and another terminal of the first pull-down module 80 is electrically connected to the low potential line.

Wherein the second scanning line may be configured to transmit a scanning signal other than the N-th level scanning signal G(N), for example, one of an (N+1)th level scanning signal, an (N+2)th level scanning signal, an (N+3) th level scanning signal G(N+3), an (N+4)th level scanning signal, or the like sequentially corresponding to scanning signals transmitted on the first scanning line.

In one of the embodiments, the first pull-down module 80 may include a thin film transistor T31, where one of a source/drain of the thin film transistor T31 is electrically connected to the another one of the source/drain of the thin film transistor T21, a gate of the thin film transistor T31 is electrically connected to the second scanning line, and another one of the source/drain of the thin film transistor T31 is electrically connected to the low potential line.

In one of the embodiments, the N-th level gate driving unit further includes a second pull-down module 90, where one terminal of the second pull-down module 90 is electrically connected to the another terminal of the pull-up control module 10, a control terminal of the second pull-down module 90 is electrically connected to the second scanning line, and another terminal of the second pull-down module 90 is electrically connected to the low potential line.

In one of the embodiments, the second pull-down module 90 may include a thin film transistor T41, where one of a source/drain of the thin film transistor T41 is electrically connected to the another one of the source/drain of the thin film transistor T11, a gate of the thin film transistor T41 is electrically connected to the second scanning line, and another one of the source/drain of the thin film transistor T41 is electrically connected to the low potential line.

It should be noted that above-mentioned thin film transistors may be N-channel thin film transistors or P-channel thin film transistors. Wherein a channel material of the thin film transistors is not specifically limited.

Figure 7:
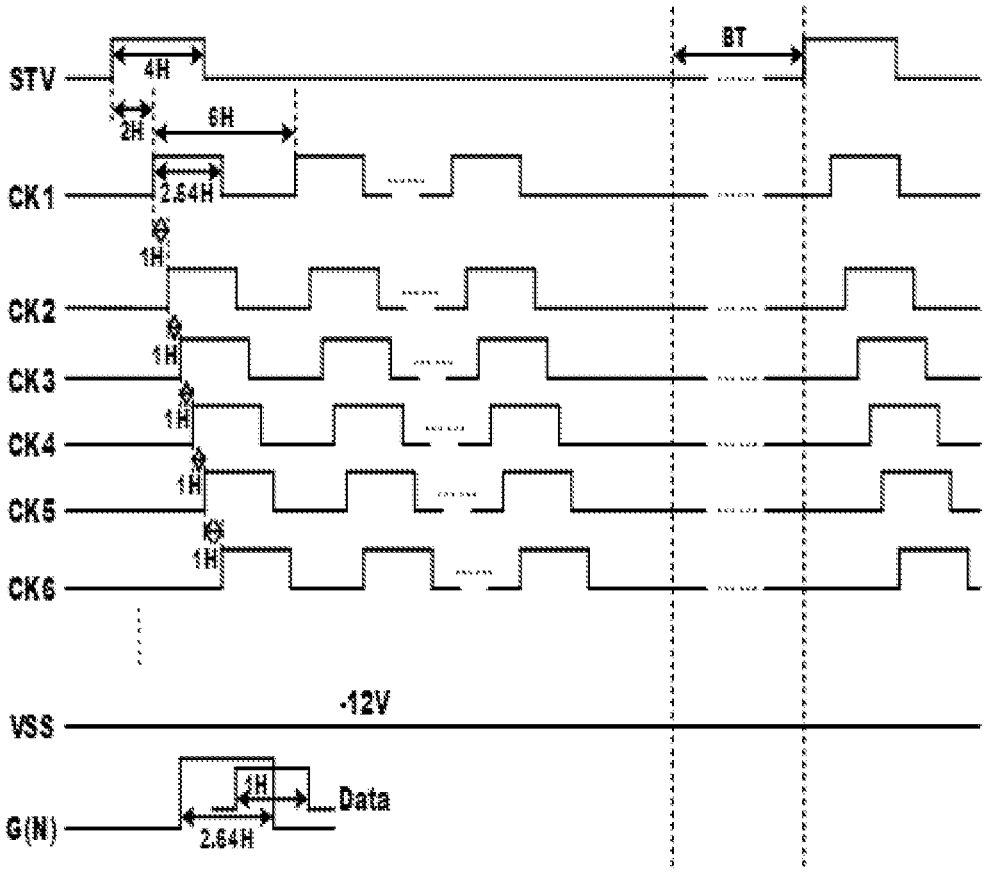
FIG. 7 is a schematic timing diagram of the GOA circuit shown in FIGS. 4-6.

It should be noted that FIG. 3 is a schematic timing diagram of the GOA circuits shown in FIG. 1 and FIG. 2, and FIG. 7 is a schematic timing diagram of the GOA circuits shown in FIGS. 4-6. In comparison with FIGS. 3 and 7, a difference between the two is only that the reset signal Reset and the initial signal STV have different names, but phases and frequencies of the reset signal Reset and the initial signal STV are same. Therefore, the two may be substantially same. Compared to the GOA circuits shown in FIGS. 1 and 2, the GOA circuits shown in FIGS. 4 to 6 employ a smaller number of thin film transistors, and a same output timing as the GOA circuits shown in FIGS. 1 and 2 can be achieved with a smaller space occupied by a bezel.

As shown in FIGS. 3 and 7, there is a vertical blank period BT between two pulses of the reset signal Reset or the initial signal STV, and an end point of the vertical blank period BT coincides with or is at a same time point as a pulse rising edge of the reset signal Reset or the initial signal STV. Assuming that one cycle of the clock signal CK is 6H, a high-level duration of the clock signal CK is 2.64H, and a low-level duration of the clock signal CK is 3.36H; a pulse duration of the reset signal Reset or the initial signal STV is 4H, and one pulse rising edge corresponding to the reset signal Reset or the initial signal STV is earlier than a pulse rising edge 2H of the first clock signal CK1; a rising edge interval of two adjacent clock signals may be 1H, a pulse duration of the N-th scanning signal G(N), that is, a gate line opening time of a corresponding row of sub-pixels is 2.64H, and a pulse duration of a corresponding data signal Data, that is, a charging time of the corresponding row of the sub-pixels is 1H; wherein the gate line opening time of the corresponding row of the sub-pixels at least partially overlaps the charging time of the corresponding row of the sub-pixels. A potential of the low potential signal VSS may be, but not limited to, −12 V. H may be any time period. For example, H may be, but not limited to, any value between 0.1 and 5 microseconds, and in particular may be 0.2 microseconds, 0.3 microseconds, . . . , 0.5 microseconds, 1.0 microsecond, etc. Alternatively, H can be also individually customized according to resolution of the display panel.

In one of the embodiments, the present embodiment provides an array substrate including a clock line and the GOA circuit in at least one embodiment mentioned above, where a clock line is configured to transmit a clock signal CK.

It can be understood that, according to a display device provided in the embodiment, the output terminal of the inversion module 20 can output a control signal by configuring all of the first input terminal of the inversion module 20, the second input terminal of the inversion module 20, and the second control terminal of the inversion module 20 to connect with the clock signal CK. Since the frequency of the clock signal CK is much higher than the frequency of the low-frequency control signal, the potential of the output signal of the inversion module 20 can be alternately switched at a relatively fast speed between the high potential and the low potential. Therefore, the duration during which the output signal of the inversion module 20 is kept at the same potential is reduced, and the stress action to which the thin film transistors connected to the output terminal of the inversion module 20 are subject can be reduced, thereby improving the trustworthiness and the reliability of the GOA circuit. Meanwhile, the inversion module 20 shares the clock line commonly used by the GOA circuit, which saves the signal transmission lines for transmitting the low frequency control signal and further reduces a bezel space required by the GOA circuit.

It can be understood that, for those ordinary skilled in the art, equivalent replacements or changes can be made according to the technical solutions and inventive concepts of the present application, and all such changes or replacements should fall within the protection scope of the claims appended to the present application.

What is claimed is:

1. A gate on array (GOA) circuit, comprising a plurality of cascaded gate driving units, wherein an N-th level gate driving unit comprises an inversion module, wherein a first control terminal of the inversion module is electrically connected to a pull-up node, all of a second control terminal of the inversion module, a first input terminal of the inversion module, and a second input terminal of the inversion module are connected with a clock signal, a third input terminal of the inversion module is electrically connected to a low potential line, and an output terminal of the inversion module is configured to output a control signal, wherein the N-th level gate driving unit further comprises:

a first feedback sub-module, wherein a control terminal of the first feedback sub-module is electrically connected to the output terminal of the inversion module, and one terminal of the first feedback sub-module is electrically connected to the low potential line; and a cascaded module, wherein a control terminal of the cascaded module is electrically connected to the pull-up node, one terminal of the cascaded module is connected with the clock signal, and another terminal of the cascaded module is electrically connected to another terminal of the first feedback sub-module.

2. The GOA circuit according to claim 1, wherein the inversion module comprises:

a first transistor, wherein one of a source/drain of the first transistor and a gate of the first transistor are both connected with the clock signal;

a second transistor, wherein a gate of the second transistor is electrically connected to another one of the source/drain of the first transistor, and one of a source/drain of the second transistor is connected with the clock signal;

a third transistor, wherein one of a source/drain of the third transistor is electrically connected to the low potential line, and another one of the source/drain of the third transistor is electrically connected to the gate of the second transistor; and a fourth transistor, wherein a gate of the fourth transistor is electrically connected to a gate of the third transistor and the pull-up node, one of a source/drain of the fourth transistor is electrically connected to the low potential line, and another one of the source/drain of the fourth transistor is electrically connected to another one of the source/drain of the second transistor to output the control signal.

3. The GOA circuit according to claim 2, wherein a channel type of the first transistor is same as a channel type of the second transistor, a channel type of the third transistor, and a channel type of the fourth transistor.

4. The GOA circuit according to claim 1, wherein the first feedback sub-module comprises a fifth transistor, wherein one of a source/drain of the fifth transistor is electrically connected to the low potential line, another one of the source/drain of the fifth transistor is electrically connected to the another terminal of the cascaded module, and a gate of the fifth transistor is electrically connected to the output terminal of the inversion module; and the cascaded module comprises a sixth transistor, wherein one of a source/drain of the sixth transistor is connected with the clock signal, another one of the source/drain of the sixth transistor is electrically connected to the another one of the source/drain of the fifth transistor, and a gate of the sixth transistor is electrically connected to the pull-up node.

5. The GOA circuit according to claim 1, wherein the N-th level gate driving unit further comprises:

a pull-up module, wherein a control terminal of the pull-up module is electrically connected to the pull-up node, one terminal of the pull-up module is connected with the clock signal, and another terminal of the pull-up module is electrically connected to an N-th level scanning line; and a second feedback sub-module, wherein one terminal of the second feedback sub-module is electrically connected to the low potential line, another terminal of the second feedback sub-module is electrically connected to the another terminal of the pull-up module, and a control terminal of the second feedback sub-module is electrically connected to the output terminal of the inversion module.

6. The GOA circuit according to claim 5, wherein the second feedback sub-module comprises a seventh transistor, wherein one of a source/drain of the seventh transistor is electrically connected to the low potential line, another one of the source/drain of the seventh transistor is electrically connected to the another terminal of the pull-up module, and a gate of the seventh transistor is electrically connected to the output terminal of the inversion module.

7. The GOA circuit according to claim 5, wherein the N-th level gate driving unit further comprises a third feedback sub-module, wherein one terminal of the third feedback sub-module is electrically connected to the low potential line, another terminal of the third feedback sub-module is electrically connected to the pull-up node, and a control terminal of the third feedback sub-module is electrically connected to the output terminal of the inversion module.

8. The GOA circuit according to claim 7, wherein the third feedback sub-module comprises an eighth transistor, wherein one of a source/drain of the eighth transistor is electrically connected to the low potential line, another one of the source/drain of the eight transistor is electrically connected to the pull-up node, and a gate of the eighth transistor is electrically connected to the output terminal of the inversion module.

9. The GOA circuit according to claim 1, wherein the N-th level gate driving unit further comprises:

a cascaded module, wherein a control terminal of the cascaded module is electrically connected to the pull-up node, and one terminal of the cascaded module is connected with the clock signal;

a pull-up module, wherein a control terminal of the pull-up module is electrically connected to the pull-up node, one terminal of the pull-up module is connected with the clock signal, and another terminal of the pull-up module is electrically connected to an N-th level scanning line;

a second feedback sub-module, wherein one terminal of the second feedback sub-module is electrically connected to the low potential line, and a control terminal of the second feedback sub-module is electrically connected to the output terminal of the inversion module; and a fourth feedback sub-module, wherein one terminal of the fourth feedback sub-module is electrically connected to another terminal of the second feedback sub-module and the another terminal of the pull-up module, another terminal of the fourth feedback sub-module is electrically connected to another terminal of the cascaded module, and a control terminal of the fourth feedback sub-module is connected with the clock signal.

10. The GOA circuit according to claim 9, wherein the second feedback sub-module comprises a seventh transistor, wherein one of a source/drain of the seventh transistor is electrically connected to the low potential line, and a gate of the seventh transistor is electrically connected to the output terminal of the inversion module; and the fourth feedback sub-module comprises a ninth transistor, wherein one of a source/drain of the ninth transistor is electrically connected to the another terminal of the second feedback sub-module and the another terminal of the pull-up module, another one of the source/drain of the ninth transistor is electrically connected to the another terminal of the cascaded module, and a gate of the ninth transistor is connected with the clock signal.

11. The GOA circuit according to claim 1, wherein the low potential line is configured to transmit a low potential signal; and the output terminal of the inversion module is configured to output a portion of the clock signal in a pulse duration of the clock signal, and the output terminal of the inversion module is further configured to output a portion of the low potential signal outside the pulse duration.

12. The GOA circuit according to claim 11, wherein the pull-up node is configured to provide a corresponding pull-up control signal, and a potential of the pull-up control signal is opposite to a potential of the clock signal during the pulse duration of the clock signal.

13. An array substrate, comprising a clock line and a gate on array (GOA) circuit, comprising a plurality of cascaded gate driving units, wherein an N-th level gate driving unit comprises an inversion module, wherein a first control terminal of the inversion module is electrically connected to a pull-up node, all of a second control terminal of the inversion module, a first input terminal of the inversion module, and a second input terminal of the inversion module are connected with a clock signal, a third input terminal of the inversion module is electrically connected to a low potential line, and an output terminal of the inversion module is configured to output a control signal, wherein the clock line is configured to transmit the clock signal, wherein the N-th level gate driving unit further comprises:

a first feedback sub-module, wherein a control terminal of the first feedback sub-module is electrically connected to the output terminal of the inversion module, and one terminal of the first feedback sub-module is electrically connected to the low potential line; and a cascaded module, wherein a control terminal of the cascaded module is electrically connected to the pull-up node, one terminal of the cascaded module is connected with the clock signal, and another terminal of the cascaded module is electrically connected to another terminal of the first feedback sub-module.

14. The array substrate according to claim 13, wherein the inversion module comprises:

a first transistor, wherein one of a source/drain of the first transistor and a gate of the first transistor are both connected with the clock signal;

a second transistor, wherein a gate of the second transistor is electrically connected to another one of the source/drain of the first transistor, and one of a source/drain of the second transistor is connected with the clock signal;

a third transistor, wherein one of a source/drain of the third transistor is electrically connected to the low potential line, and another one of the source/drain of the third transistor is electrically connected to the gate of the second transistor; and a fourth transistor, wherein a gate of the fourth transistor is electrically connected to a gate of the third transistor and the pull-up node, one of a source/drain of the fourth transistor is electrically connected to the low potential line, and another one of the source/drain of the fourth transistor is electrically connected to another one of the source/drain of the second transistor to output the control signal.

15. The array substrate according to claim 14, wherein a channel type of the first transistor is same as a channel type of the second transistor, a channel type of the third transistor, and a channel type of the fourth transistor.

16. The array substrate according to claim 13, wherein the first feedback sub-module comprises a fifth transistor, wherein one of a source/drain of the fifth transistor is electrically connected to the low potential line, another one of the source/drain of the fifth transistor is electrically connected to the another terminal of the cascaded module, and a gate of the fifth transistor is electrically connected to the output terminal of the inversion module; and the cascaded module comprises a sixth transistor, wherein one of a source/drain of the sixth transistor is connected with the clock signal, another one of the source/drain of the sixth transistor is electrically connected to the another one of the source/drain of the fifth transistor, and a gate of the sixth transistor is electrically connected to the pull-up node.

17. The array substrate according to claim 13, wherein the N-th level gate driving unit further comprises:

a pull-up module, wherein a control terminal of the pull-up module is electrically connected to the pull-up node, one terminal of the pull-up module is connected with the clock signal, and another terminal of the pull-up module is electrically connected to an N-th level scanning line; and a second feedback sub-module, wherein one terminal of the second feedback sub-module is electrically connected to the low potential line, another terminal of the second feedback sub-module is electrically connected to the another terminal of the pull-up module, and a control terminal of the second feedback sub-module is electrically connected to the output terminal of the inversion module.

18. The array substrate according to claim 17, wherein the second feedback sub-module comprises a seventh transistor, wherein one of a source/drain of the seventh transistor is electrically connected to the low potential line, another one of the source/drain of the seventh transistor is electrically connected to the another terminal of the pull-up module, and a gate of the seventh transistor is electrically connected to the output terminal of the inversion module.

* * * * *